United States Patent [19]

Kasahara

[11] 4,018,522

[45] Apr. 19, 1977

[54] COLOR ELECTROPHOTOGRAPHIC COPYING MACHINE

[75] Inventor: Nobuo Kasahara, Yokohama, Japan

[73] Assignee: Ricoh Co., Ltd., Japan

[22] Filed: Aug. 22, 1975

[21] Appl. No.: 606,980

[30] Foreign Application Priority Data

Aug. 29, 1974 Japan ..... 49-99170
Sept. 3, 1974 Japan ..... 49-101056

[52] U.S. Cl. ..... 355/4; 96/1.2; 355/10

[51] Int. Cl.[2] ..... G03G 15/01

[58] Field of Search ..... 355/4, 10, 3 SH, 3 TE, 355/3 R; 96/1.2, 1 TE

[56] References Cited

UNITED STATES PATENTS

| | | | |
|---|---|---|---|
| 3,130,655 | 4/1964 | Meyer et al. | 96/1.2 X |
| 3,709,593 | 1/1973 | Matsumoto et al. | 355/4 |
| 3,797,930 | 4/1974 | Tanaka et al. | 355/4 |
| 3,838,920 | 10/1974 | Terashima et al. | 355/4 |
| 3,848,990 | 11/1974 | Otubo et al. | 355/4 |
| 3,958,876 | 5/1976 | Terashima | 355/4 |

*Primary Examiner*—L. T. Hix
*Assistant Examiner*—J. A. LaBarre
*Attorney, Agent, or Firm*—McGlew and Tuttle

[57] ABSTRACT

A copy sheet is held between a reciprocally rotatable drum and a holding roller which bears against the drum, and for each reciprocal rotation of the drum, an electrostatic latent image corresponding to one of a plurality of selected color separation images is formed on the sheet and each image is developed with a corresponding color developing solution. A mechanism is provided which is effective to prevent misalignment, in particular, lateral misalignment, between the plurality of color separation images which are formed in superposed manner on the sheet. After the formation of the electrostatic latent image, the sheet on the drum has its free end moved away from the peripheral surface thereof and is delivered, in floating condition, into a vessel which contains a corresponding color developing solution for the purposes of developing. This manner of developing minimizes the attachment of color developing solutions to unwanted portions and to prevent a mixing of different color developing solutions.

9 Claims, 16 Drawing Figures

COLOR ELECTROPHOTOGRAPHIC COPYING MACHINE

BACKGROUND OF THE INVENTION

The invention relates to a color electrophotographic copying machine.

The color electrophotography which is utilized for copying purposes can be categorized into two transfer types, in which one employs the transfer of a toner image onto a record sheet, and the other transfers an electrostatic latent image. In the former technique, a plurality of color filters are used to separate a color original into a plurality of color separation images, as each individual color separation image is exposed to a photosensitive member, the resulting electrostatic latent image is color developed with a toner having a complementary color relationship with the color separation image to be developed, and subsequently the toner image obtained is transferred onto a record sheet. By superimposing a plurality of complementary color toner images which result from the individual color separation images on a single record sheet, a color electrophotographic image corresponding to the original is formed on the record sheet. In the latter technique, a color electrophotographic image corresponding to the original is formed on the record sheet by repeating the process of transferring an electrostatic latent image onto the record sheet as it is formed on a photosensitive member in response to each individual color separation image or directly forming an electrostatic laten image latent the record sheet which has a photosensitive layer, and then color developing the latent image on the record sheet.

In either technique, one of the most important problems is the registration of images which are to be superimposed one above another. Thus, during the process of obtaining a single color electrophotograph, there is the need to transfer either latent image or toner image onto the record sheet a plurality of times, and if there is any misalignment between the toner image or the latent image to be transferred and the record sheet during each transfer step, there results a color misalignment in the electrophotographic image obtained.

More particularly, such misalignment, which refers herein to the order of resolution of the naked eye, namely, 0.1 mm, is in two parts; i.e., a longitudinal misalignment which is attributable to the improper timing with which the record sheet, after having received a color image and moved in a particular direction for the purpose of developing or drying or both and returned to the original position, again meets with the photosensitive member or optical system which supplies another color image to the record sheet; and a lateral misalignment or misalignment in a direction transverse to the longitudinal misalignment which may be caused by uncontrollable tendencies of the sheet carrying system or other machine components. The longitudinal misalignment can essentially be overcome by improving the accuracy of a synchronizing apparatus which controls the timing with which the record sheet meets with the photosensitive member or optical system, but the lateral misalignment cannot be simply overcome because of the uncontrollable factors involved.

Another problem in color electrophotography accrues from the use of a plurality of developers of different colors during the developing process. Taking a conventional copying machine by way of example, the process of forming an electrostatic latent image on the surface of a photosensitive drum which rotates in one direction and then developing the latent image by direct contact with a developing solution during one revolution of the drum, is repeated during successive cycles, using developing solutions of different colors. However, with this process, the period of time for contact between the latent image and the developing solution may be too short to provide a satisfactory developing, or difficulty may be experienced when squeezing residual developing solution from the drum surface. Of greater importance is the effect of any remaining small amount of toner on the drum surface which may be mixed with a developing solution of different color to cause a discoloration.

SUMMARY OF THE INVENTION

It is a principal object of the invention to provide a color electrophotographic copying machine which is capable of eliminating the above-mentioned misalignment, in particular, the lateral misalignment, using a relatively simple mechanism.

It is another object to provide a color electrophotographic copying machine which minimizes the above-mentioned problems of developing.

Other objects and features of the invention will become apparent from the following description of several embodiments thereof with reference to the drawings.

DETAILED DESCRIPTION OF EMBODIMENTS

Figure 1:
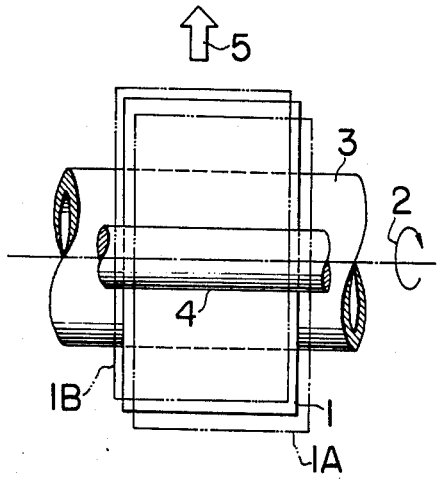
FIGS. 1 and 2 are front views of a conveying drum and a pressure roller, illustrating the principle of the invention.
Figure 2:
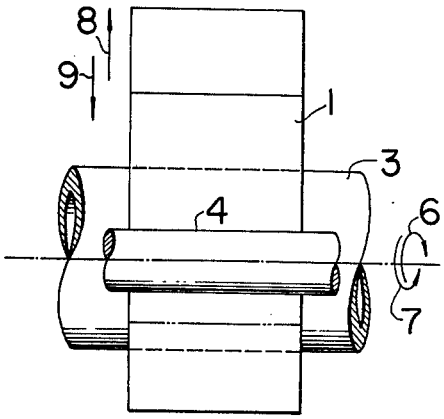

Referring to FIG. 1, a sheet 1 is pressed against the peripheral surface of a conveying drum 3 by means of a pressure roller 4 so as to be cyclically conveyed in one direction indicated by an arrow 5, the drum being rotated in a direction indicated by an arrow 2. The initial pass of the sheet 1 is indicated in solid line while phantom lines 1A and 1B indicate the displaced path which the sheet 1 may follow during subsequent passes. Such displacement may cause a misalignment between toner images or electrostatic latent images of complementary colors. It is difficult to prevent such a displacement of the sheet 1 no matter how the machining and mounting accuracy of the conveying roller 3 and the pressure roller 4 may be improved. FIG. 2 illustrates the principle of the invention, which is intended to avoid such misalignment. The conveying drum 3 is adapted to be rotated forwardly and reversely, as indicated by arrows 6 and 7, so as to reciprocate the sheet 1 in the directions indicated by arrows 8 and 9. When the sheet 1 is conveyed in this manner, it will be appreciated that if the sheet 1 may be displaced transversely or skewed during its pass, a similar displacement or skew condition will occur during the return path, so that the registration of images can be positively achieved using a simple mechanism without substantially increasing the precision of the drum 3 and the pressure roller 4.

Figure 4:
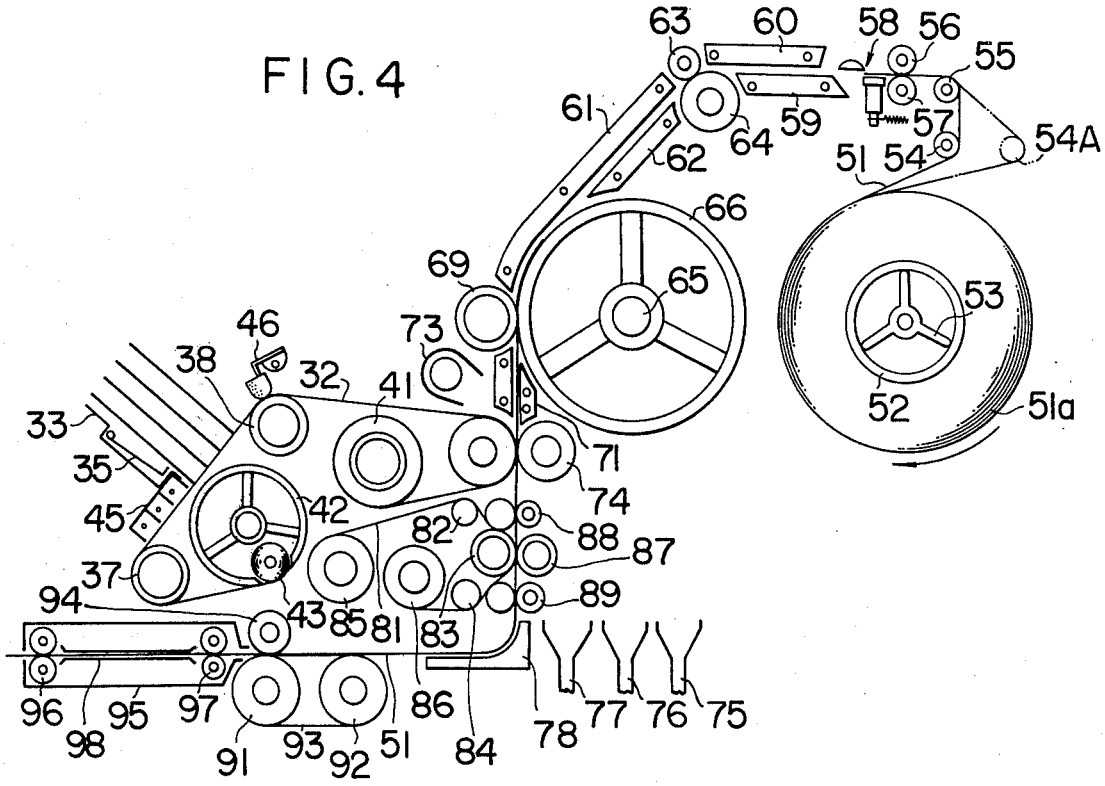
FIG. 4 is a schematic view illustrating the operation of the machine shown in FIG. 3.
Figure 3:
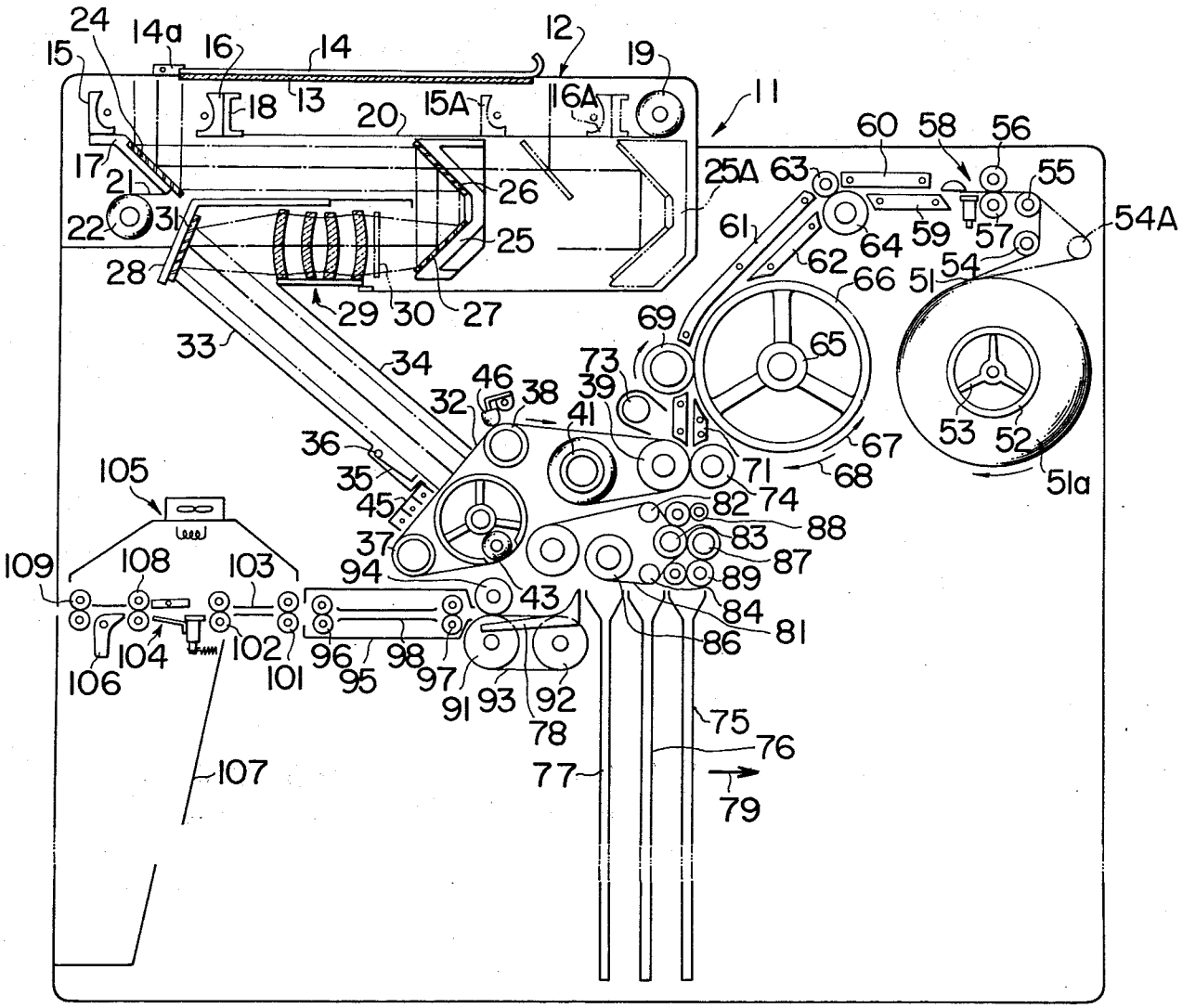
FIG. 3 is a front view of a color electrophotographic copying machine constructed in accordance with one embodiment of the invention.

Referring to FIGS. 3 and 4 there is shown a color electrophotographic copying machine 11 which incorporates the above-mentioned registration mechanism. Specifically, the machine 11 includes an optical system 12 in its upper portion, and a transparent original receptacle 13 is fixedly mounted on top of the optical system. A color original, not shown, which is placed on the receptacle 13, is held flat thereagainst by a pressure plate 14 which is pivotally mounted at 14a. A pair of lamp units 15, 16, including reflectors for irradiating the color original, are fixedly mounted on a pair of substantially integral shaped support members 17, 18, respectively. A shield diaphragm 20 has its one end secured to the member 18 and its other end secured to a take-up roller 19, and prevents an external leakage of light from the lamp units. The lamp units are adapted to be moved to positions 15A, 16A shown in phantom lines by drive means, not shown, for irradiating the color original. A take-up member 21, having its one end secured to the support plate 17, has its other end taken up on a rewind roller 22 for returning the lamp units 16, 17 to their initial positions shown in solid line.

A reflecting mirror 24 is fixedly mounted on the support plate 17 while a pair of reflecting mirrors 26, 27 are fixedly mounted on a movable member 25 at right angles with each other, these mirrors being effective to direct the reflected light from the color original to a lens unit 29 which is fixedly mounted on a stationary member. After passing through the lens unit 29, the light is reflected by a reflector mirror 31 which is fixedly mounted on a stationary member 28 and is projected onto a belt-shaped photosensitive member 32 having a photoconductive response. Before passing through the lens unit 29, the light is directed through an interchangeable filter 30, whereby a color separation image corresponding to the filter 30 used is projected onto the photosensitive member 32. A pair of shield plates 33, 34 form a light path for the reflected light, and a diaphragm 35 is mounted internally of the shield plates for pivotal motion about a pin 36 for adjusting the amount of reflected light let therethrough. The movable member 25 is movable to a position 25A shown in phantom lines, in a direction parallel to the original receptacle 13, the rate of its movement being one-half that of the lamp units 15, 16 so that the length of the light path between the color original and the lens unit 29 can be maintained constant. The photosensitive member 32 extends around a pair of guide rollers 37, 38 and a transfer roller 39, one end of the member 32 being wrapped around a take-up roller 41 and its other end being wrapped around a supply shaft 43 which is internally housed within a rewind drum 42. As the photosensitive member 32 becomes degraded, a fresh length of the photosensitive member is supplied from within the drum 42. When the photosensitive member 32 rotates clockwise, as viewed in this FIGURE, it is charged by a corona charger 45, while a cleaner 46 is moved into contact with the photosensitive member for the purpose of cleaning it as it rotates counterclockwise.

A roll 51*a* of record sheet is carried by a spool 52 which is in turn mounted on a rotatable retainer 53, and a portion of record sheet 51 which is unreeled from the roll 51*a* extends around a pair of guide rollers 54, 55, and then between a pair of rollers 56, 57, the leading end of the sheet normally extending to the position of a cutter 58, as shown. Pairs of guide plates 60, 59 and 61, 62 form a path for the record sheet 51, and a pair of feed rollers 63, 64 interposed between the pairs of guide plates function to convey the record sheet 51. An axle 65 is mounted on a stationary member and rotatably carries a conveying drum 66, which is adapted to be alternately rotated in the directions indicated by arrows 67 and 68. A pressure roller 69, having its axis parallel to that of the conveying drum 66, bears against the peripheral surface thereof, whereby the peripheral surface of the pressure roller 68 rotates in the same direction as, and a speed synchronized with the peripheral surface of the conveying drum 66.

A discharge lamp 73, for eliminating residual charge on the record sheet 51, is disposed adjacent to a pair of guide plates 71 and may utilize a.c. corona, d.c. corona or a combination thereof. As the record sheet 51 passes by the transfer roller 39, a pressure roller 74 moves toward the transfer roller to urge the record sheet against the photosensitive member 32. A plurality of vessels 75, 76, and 77 contain developing solutions of cyan, magenta and yellow colors, respectively, and these vessels, as well as a guide plate 78, are adapted to be moved intermittently in the direction indicated by an arrow 79 at each end of one developing step which is effected on the recording sheet. A belt-shaped blotter 81 is disposed above the vessels for removing developing solutions from the record sheet 51 subsequent to each developing step, and extends around rollers 82, 83, 84. The opposite ends of the blotter 81 are wrapped around take-up rollers 85, 86, respectively. A roller 87 functions to urge the record sheet 51 against the blotter 81, while pairs of rollers 88, 89 guide the access of the record sheet 51 into the vessels 75, 76, and 77, respectively.

To the left of the vessel 77, as viewed in this Figure, there is provided a pair of rollers 91, 92 around which a conveyor belt 93 extends and cooperates with a roller 94 which bears against it for feeding the record sheet 51 into a vessel 95 containing a black developing solution. Pairs of feed rollers 96, 97 and a pair of guide plates 98 are disposed within the vessel 95. There are also provided pairs of feed rollers 101 and 102 as well as pair of guide plates 103 for conveying the record sheet 51, which has completed its developing in black color, to a cutter 104. The record sheet 51 is dried by a dryer 105. A guide member 106 guides the chips cut from the record sheet 51, into a dust box 107, while the record sheet 51 cut to size, is delivered by pairs of feed rollers 108, 109 to the exterior of the copying machine.

In operation, as the movable optical system 12 scans the color original, a color separation image is projected onto the photosensitive member 32 which is traveling in the direction indicated by an arrow, whereby an electrostatic latent image corresponding to the color separation image is formed thereon. At the same time, pairs of conveying rollers 56, 57, 63, and 64 convey the record sheet 51 into the nip between the conveying drum 66, which rotates in the direction of the arrow 67, and the pressure roller 69, whereby it is fed into the nip between the transfer roller 39 and the pressure roller 74, the pressure roller 74 continuously engaging the record sheet and urging it against the photosensitive member 32. During the time the record member is urged against the photosensitive member 32, the latent image formed on the member 32 is transferred onto the record sheet 51, and subsequently the latter is fed by pairs of feed rollers 88, 89 into the vessel 75 while remaining engaged between drum 68 and pressure roller 69. As a consequence, a toner image corresponding to the color separation image is formed on the record sheet 51. Upon completion of the developing step, the record sheet 51 is conveyed away from the vessel 75. At this time, the guide roller 54 is moved to a position 54A, shown in phantom lines, in order to take up the slack in the sheet 51. In order to withdraw the record sheet 51 from the vessel 75, the feed rollers 88, 89 as well as 63, 64, 56, 57 are rotated in the reverse direction and the conveying drum 66 is rotated in the direction of the arrow 68, and the pressure roller 69 is rotated in the opposite direction. At this time, the record sheet 51 is freed from the action of the pressure roller 74 which previously urged it against the photosensitive member 32. During the returning motion of the record sheet 51 (that is, movement of the sheet in a direction away from the vessel 75), the developing solution which may remain attached to the sheet 51 is removed by the blotter 81, and any residual charge on the sheet 51 is eliminated by the discharger 73. Also during the returning motion of the record sheet 51, the photosensitive member 32 is moved in the opposite direction from that indicated by the arrow, and the cleaner 46, which has been kept away therefrom during the forward movement of the record sheet, is moved into contact with the photosensitive member 32 for cleaning it.

When a toner image corresponding to a color separation image which is produced by the use of one filter 30 is formed on the record sheet 51, the filter 30 is replaced by another one, and the vessels 75, 76 and 77 as well as the guide plate 78, are moved one pitch in the direction of the arrow 79 so that the next vessel 76 is located in alignment with the path of movement of the record sheet 51. Under this condition, a similar operation is performed to produce an electrostatic latent image on the photosensitive member 32, which latent image is superimposed on the previously formed toner image of the record sheet 51, which is then fed into the vessel 76 which contains a toner having a complementary color relationship with this latent image. Such process is repeated for the third vessel 77, thereby producing superimposed cyan, magenta and yellow images on the record sheet 51. Subsequently, the record sheet is cut by the cutter 58 at a position which defines the rear margin of one frame, and conveyed on the guide plate 78 into the vessel 95 in which a tone adjustment is made. Thereafter the record sheet 51 is cut to size and delivered to the outside of the copying machine.

Figure 5:
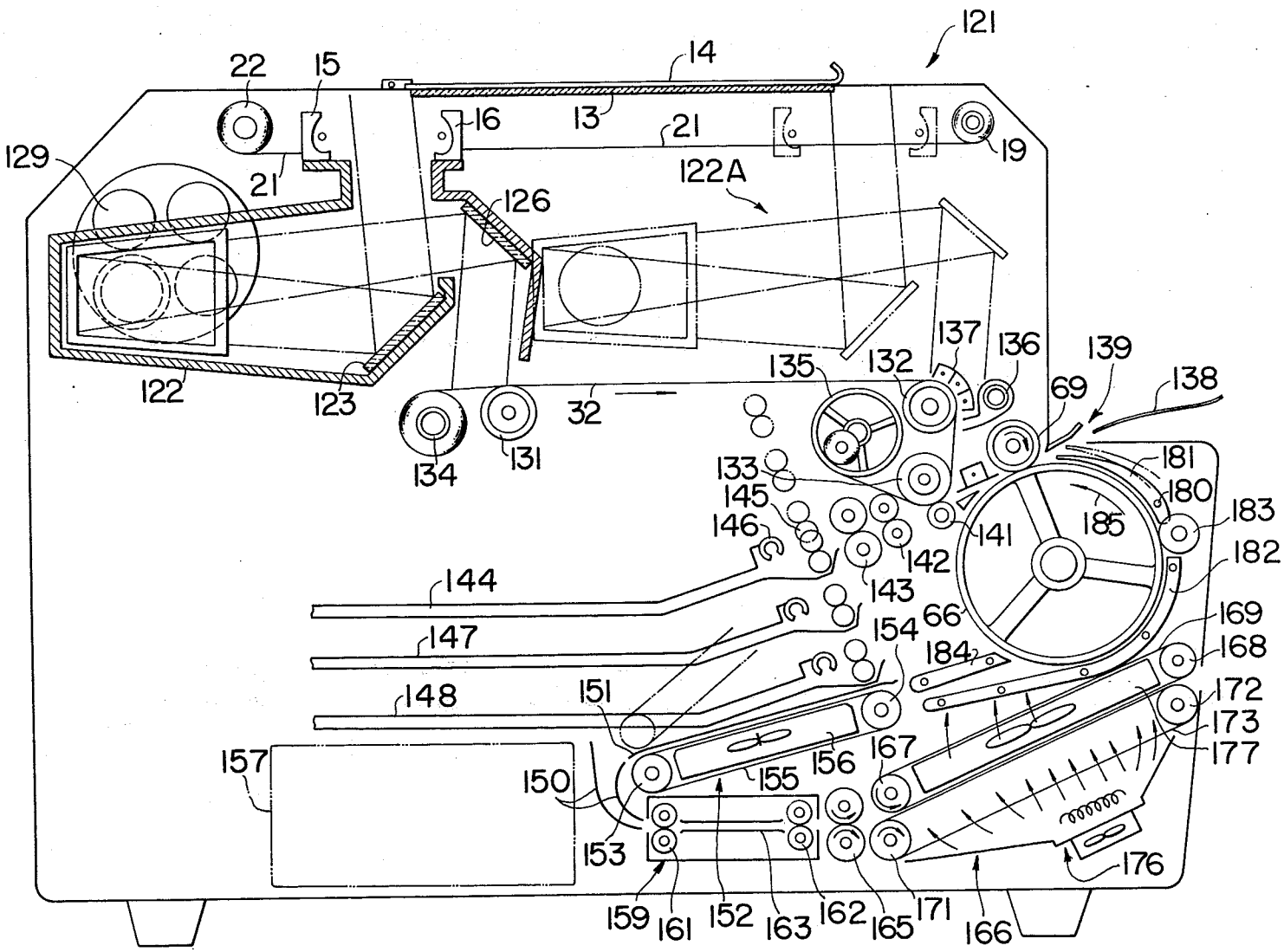
FIG. 5 is a front view of a color electrophotographic copying machine constructed in accordance with another embodiment of the invention.
Figure 9:
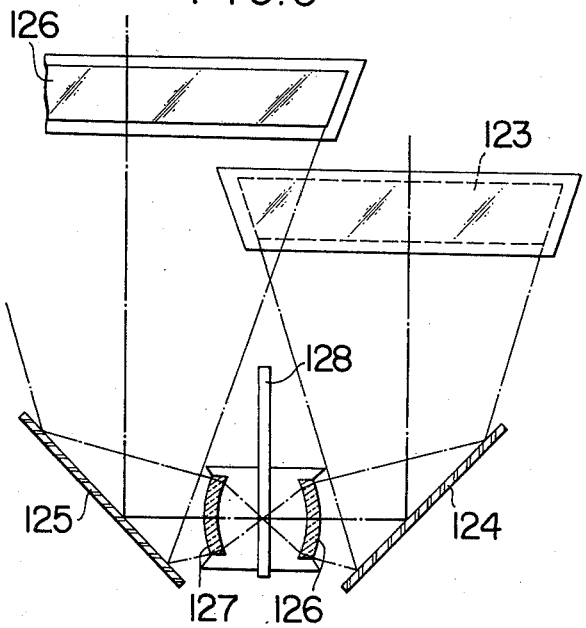
FIG. 9 is a front view of the optical system used in the machine of FIG. 5.
Figure 10:
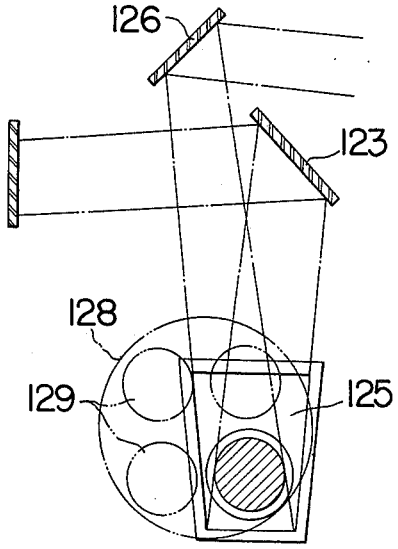
FIG. 10 is a fragmentary side elevation of the optical system.

FIG. 5 shows another color electrophotographic copying machine 121 according to the invention. It should be understood that parts functioning in the same manner as those illustrated in connection with the copying machine 11 of FIG. 3 are designated by like numerals. In FIG. 5, an optical system 122, having a pair of lamp units 15 and 16 fixedly mounted on its top, is adapted to reciprocate in the horizontal direction, as viewed in this Figure, and internally includes reflecting mirros 123, 124, 125, 126 (see FIGS. 9 and 10) for reflecting the light from a color original (not shown) onto the belt-shaped photosensitive member 32. In FIG. 9, a pair of projection lenses, 126 and 127 are disposed between the pair of reflecting mirrors 124 and 125, and a filter holder 128 is disposed between the lenses. As shown in FIG. 10, the holder 128 fixedly carries a plurality of filters 129 for color separation of a color original placed on the original receptacle 13.

The photosensitive member 32 extends around guide rollers 131, 132 and a transfer roller 133, and has its one end wrapped around a rewind roller 134 and its other end around a supply shaft which is internally mounted within a take-up drum 135. When transferring an electrostatic latent image, the photosensitive member is moved in the direction indicated by an arrow. When it moves in the opposite direction, a discharger 136 illuminates any residual charge, while a charger 137 provides a uniform charging thereof. The pressure roller 69 again bears against the peripheral surface of the conveying drum 66, and the nip therebetween is located adjacent to an inlet 139 for a record sheet 138. A pressure roller 141 bears against the transfer roller 133 with the photosensitive member 32 interposed therebetween, and pairs of feed rollers 142 and 143 function to convey the record sheet 138 toward a vessel 144.

Disposed in the opening of the vessel 144 are a pair of rollers 145 for providing access of the record sheet 138 as well as a supply pipe 146 which supplies a quantity of developing solution. Similar vessels 147, 148, which contain developing solutions, are located in juxtaposed relationship therewith, as shown. The vessels 144, 147 and 148 contain developing solutions including toners of cyan, magenta and yellow which have the complementary color relationship with the respective color separation images. After the completion of each developing step, the vessels 144, 147 and 148 are raised one pitch upwardly so that the pair of rollers associated with the respective developing vessel is successively moved into alignment with the conveying path of the record sheet.

Disposed below the developing vessel 148 are guide plates 150 and a conveying unit 152, which comprises a belt 155 extending around a pair of rollers 153, 154 and also comprises a drying unit 156. As the vessels 144, 147 and 148 are successively moved upward, the guide plate 151 and the conveying unit 152 are tilted in a direction such that the right-hand end thereof, as viewed in this Figure, is raised, as indicated in phantom lines. A developing solution supply unit 157, which is shown in phantom lines, functions to supply the respective developing solutions to the vessels 144, 147 and 148 and to withdraw the developing solutions therefrom. A pair of guide plates 150 serve for guiding the record sheet 138 to a developing unit 159 which contains a black toner. The developing unit 159 comprises pairs of feed rollers 161, 162 and guide plates 163. A pair of feed rollers 165 and a conveying unit 166 are located to the right of the unit 159. The conveying unit 166 comprises a belt 169 extending around a pair of rollers 167, 168 and another belt 173 extending around another pair of rollers 171, 172. There are provided drying units 176 and 177 for drying the record sheet 138. A switching member 181 and a guide member 182 are located adjacent to the periphery of the conveying drum 66, and a feed roller 183, which is maintained in contact with the peripheral surface of the drum 66, is interposed between these members. A separator 184 functions to separate the record sheet 138 from the periphery of the drum.

Figure 6:
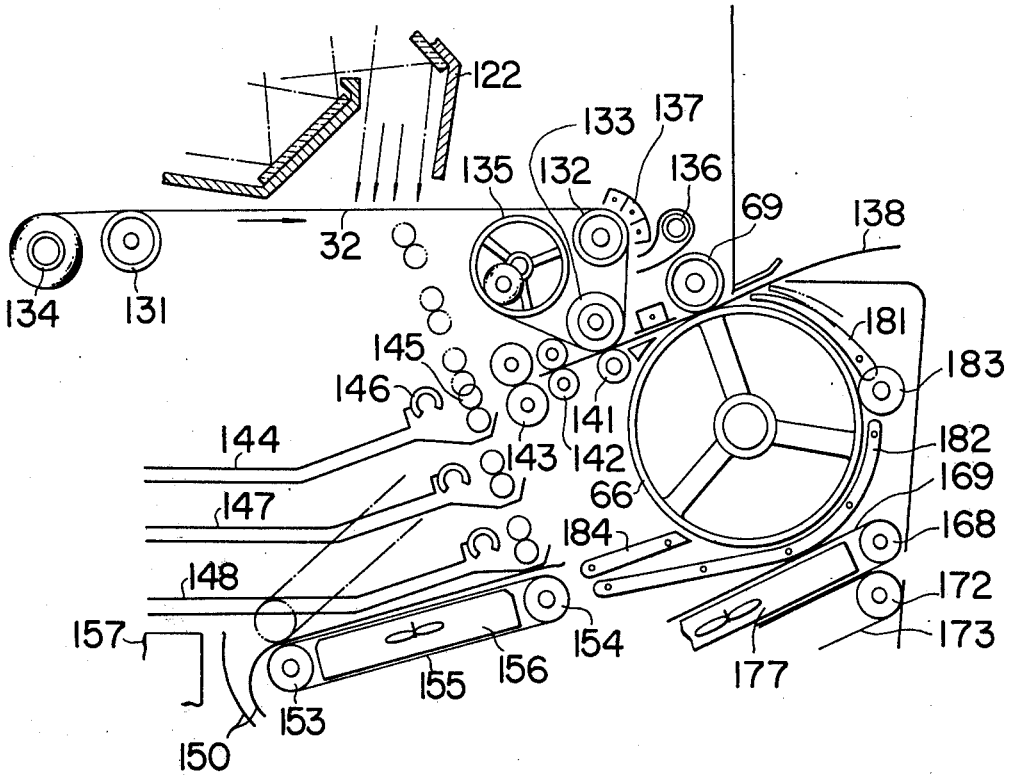
FIGS. 6 to 8 are fragmentary views illustrating the operation of the machine shown in FIG. 5.
Figure 7:
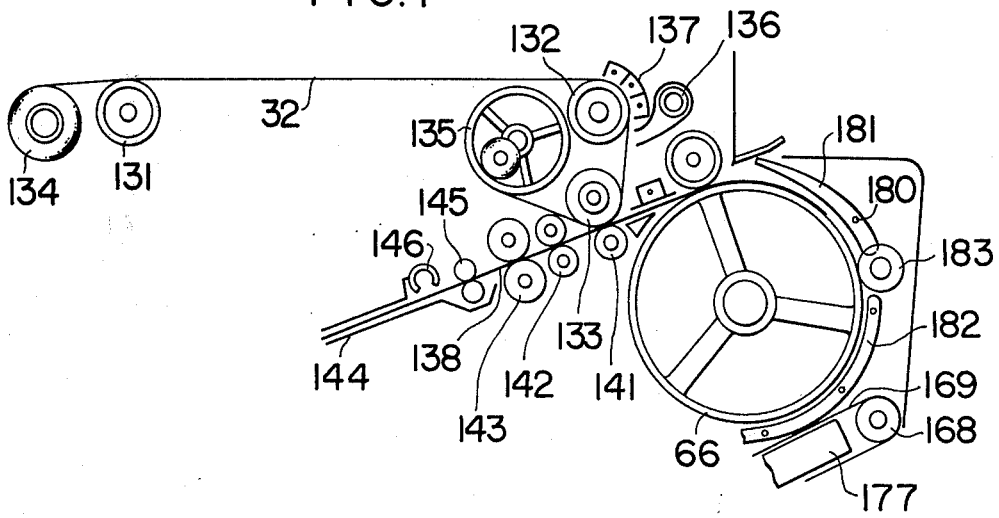

The record sheet 138 comprises sheets cut to size, and manually inserted into the copying machine 121 through the inlet 139. Upon insertion, a detector, not shown, is activated to operate the optical system 122 to move to the position 122A shown in phantom lines, thereby scanning a color original, not shown, to form a color separated, electrostatic latent image on the photosensitive member 32 which remains stationary. Upon completion of the formation of the latent image, the photosensitive member 32 is driven in the direction indicated by the arrow, as indicated in FIG. 6, while the conveying drum 66 and the pressure roller 69 are rotated forwardly, or in the direction indicated by arrow 185, thus conveying the record sheet 138 to the left, as viewed in this Figure. As the sheet is conveyed, the latent formed on the photosensitive member 32 is transferred thereto, and the sheet 138 is fed into the vessel 144 in order to be developed. Subsequent to the completion of the developing step, pairs of feed rollers 145, 143, 142, are reversed in direction, whereby the sheet 138 is withdrawn from the vessel 144. The photosensitive member 32 is driven in the opposite direction from that indicated by the arrow, and the conveying roller 66 and the pressure roller 69 are also reversed in direction. During the returning motion of the sheet 138, or when it is being withdrawn from the vessel 144, the switching member 181 is rotated clockwise about its pivot 180 as shown in FIG. 7 to block the inlet 139, thus changing the direction of travel of the sheet. As a consequence, the sheet 138 moves along the peripheral surface of the conveying drum 66, and comes to a stop once at a position where its rear end is engaged by the pressure roller 69. In the meantime, the drying units 176, 177 function to dry the sheet 138. After completion of the developing of a color separation image by the vessel 144, the vessels 144, 147 and 148 are moved one step upward, whereby the next vessel 147 is located in alignment with the conveying path of the sheet 138.

Figure 8:
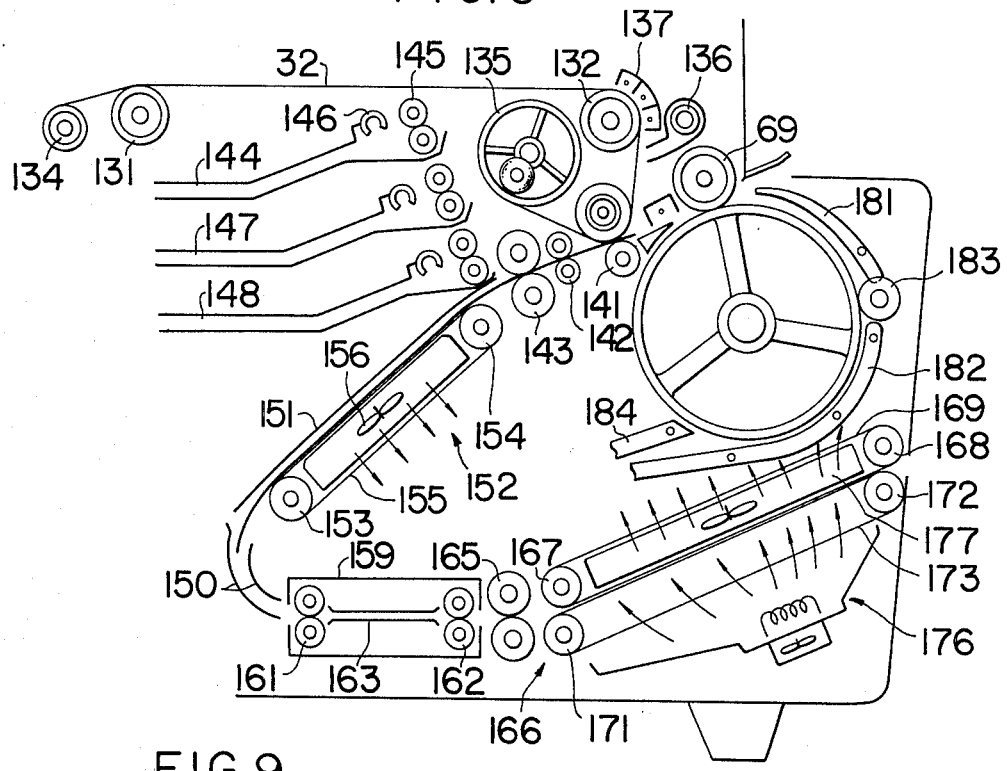

The filter 129 is changed to form another color separated, electrostatic latent image, which is again transferred onto the record sheet 138 in superposition with the previously developed toner image, and the sheet 138 then fed into the vessel 147 to be developed with a developing solution which contains a toner having a complementary color relationship with the transferred latent image. In this manner, three developing steps are performed by the three developing vessels 144, 147 and 148. Thereupon, the record sheet 138 is fed between the guide plate 151 and the conveying unit 152 and between the guide plates 150 into the developing vessel 159 which contains a black toner. After a tone adjustment in the vessel 159, the sheet 138 is dried by the drying unit 176 while it is moved by the conveying unit 166 to the exterior of the copying machine. During the process of superimposing electrostatic latent images, which are color separated by a plurality of filters 129, on the record sheet 138, the position of the sheet 138 in the transfer station where the electrostatic latent image is transferred is controlled by the feeding action of the conveying drum 66 and the pressure roller 69, so that a correct positioning of the images in the transfer station can be assured. It will be understood that after forming a single color copy, the respective vessels 144, 147 and 148 are returned from the position shown in FIG. 8 to the position shown in FIG. 5, and the conveying unit 152 is swung clockwise, as viewed in the Figure, to its original position shown in FIG. 5.

Figure 11:
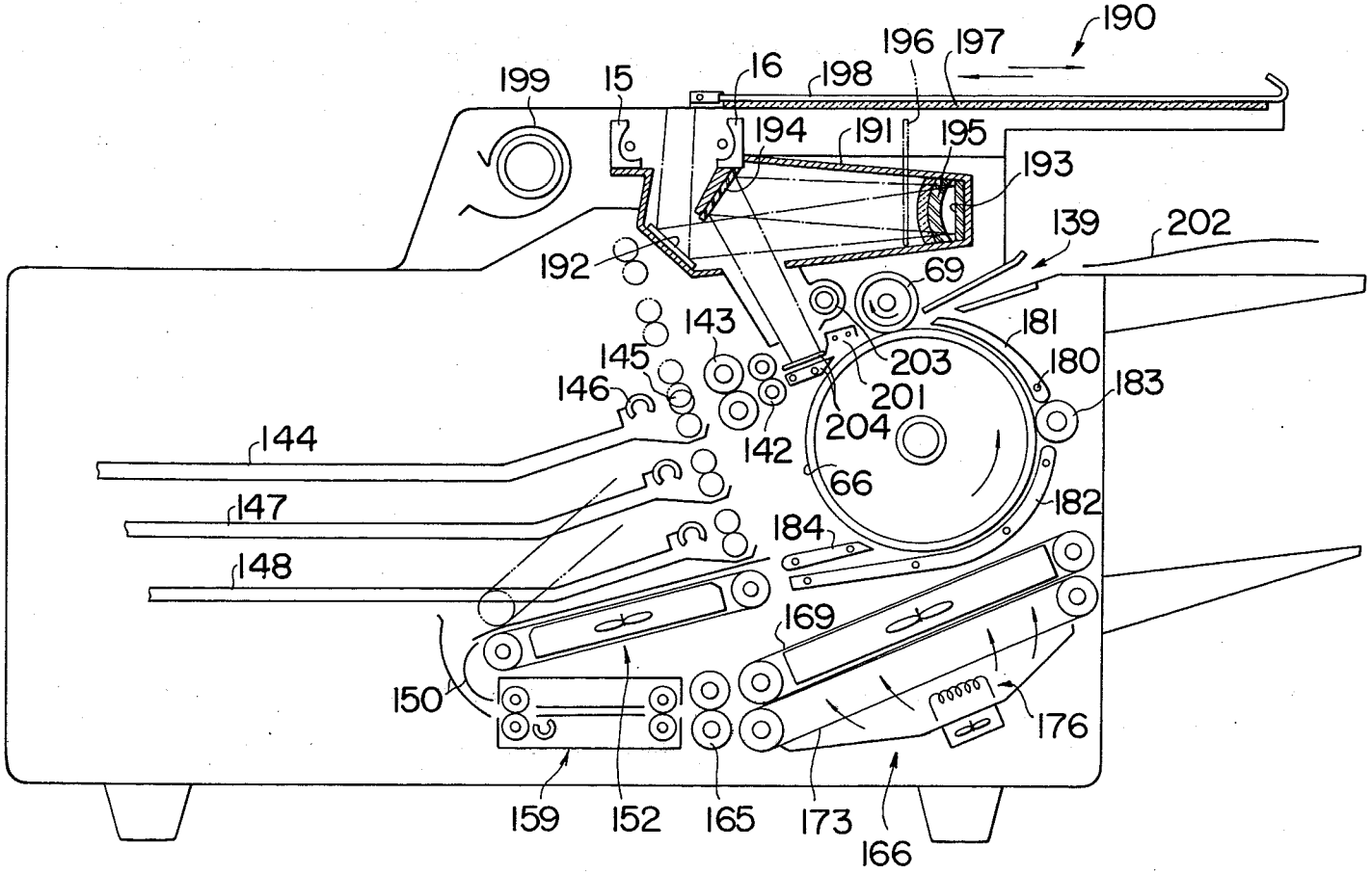
FIG. 11 shows a further embodiment of the invention.

FIG. 11 shows a color electrophotographic copying machine 190 which is constructed in accordance with the a further embodiment of the invention. Parts functioning in the same manner as those illustrated in FIG. 5 are designated by corresponding numerals. In the embodiment shown, an optical system 191, having a pair of lamp units 15, 16 mounted on its top, includes reflecting mirrors 192, 193 and 194 and a projection lens 195 in its interior. A plurality of interchangeable filters are fixedly mounted on a rotatable support plate 196 for color separation of a color original, not shown, which is placed on an original receptacle 197. The optical system 191 is immovable with respect to the copying machine 190 while the original receptacle 197 and a pressure plate 198 located thereon are capable of reciprocatory motion in the directions indicated by arrows. When they move to the left, as viewed in this Figure, the color original is scanned by the lamp units 15, 16. A fan 199 is disposed to the left of optical system 191 for the purpose of air ventilation of the machine 190.

As in the previous embodiments, the peripheral surface of the conveying roller 66 is in abutting engagement with the pressure roller 69, and a charger 201 is disposed adjacent thereto for uniformly charging a record sheet 202. There is also disposed a discharger 203 which removes any residual charge on the record sheet 202 after the completion of its developing step. The record sheet 202 has a coating of photoconductive material, such as zinc oxide on its one surface, and is manually inserted into the machine 190 through the inlet 139 with the coating disposed upwardly. When the insertion of the sheet 202 is detected, the conveying drum 66 and the pressure roller 69 are rotated forwardly, or in the directions indicated by arrow, and simultaneously the original receptacle 197 is moved to the left, as viewed in this Figure, the reflected light therefrom being projected onto the record sheet 202, in an exposure station comprising a guide plate 204, to form an electrostatic latent image thereon which corresponds to a color separation image. The guide plate 204 is in two parts, namely upper and lower parts, the upper part being located only over the both lateral edges of the record sheet 202 to avoid interference with the exposure operation. After being exposed to a single color separation image, the record sheet 202 is fed into a developing vessel 144 by pairs of feed rollers 142, 143 and a pair of rollers 145, for the purpose of developing. When the record sheet 202 is withdrawn from the vessel 144 by reversing the operation of the pairs of feed rollers 143, 142, the transfer drum 66 and the pressure roller 69, the switching member 181 is rotated clockwise about its pivot 180 to block the inlet 139, whereby the sheet 202 is guided by the switching member 181 and the guide member 182 to be moved along the peripheral surface of the conveying drum 66.

Subsequently, the process proceeds in the a manner similar to that as mentioned in connection with the machine shown in FIG. 5, the vessels 144, 147 and 148 being moved upward to develop color separation images by the following vessels 147 and 148. By controlling the conveying action applied to the record sheet 202 solely by rotating motion of the transfer drum 66 and the pressure roller 69 during the reciprocatory motion of the record sheet 202, a correct registration between the developed toner image or images and the projected color separation image is assured. After completion of the developing in the vessels 144, 147 and 148, the sheet 202 is fed by the conveying unit 152 into the developing vessel 159 which contains a black toner for the purpose of a tone adjustment. Subsequently, the sheet 202 is delivered to the exterior of the copying machine through the pair of feed rollers 165 and the conveying unit 166.

Figure 12:
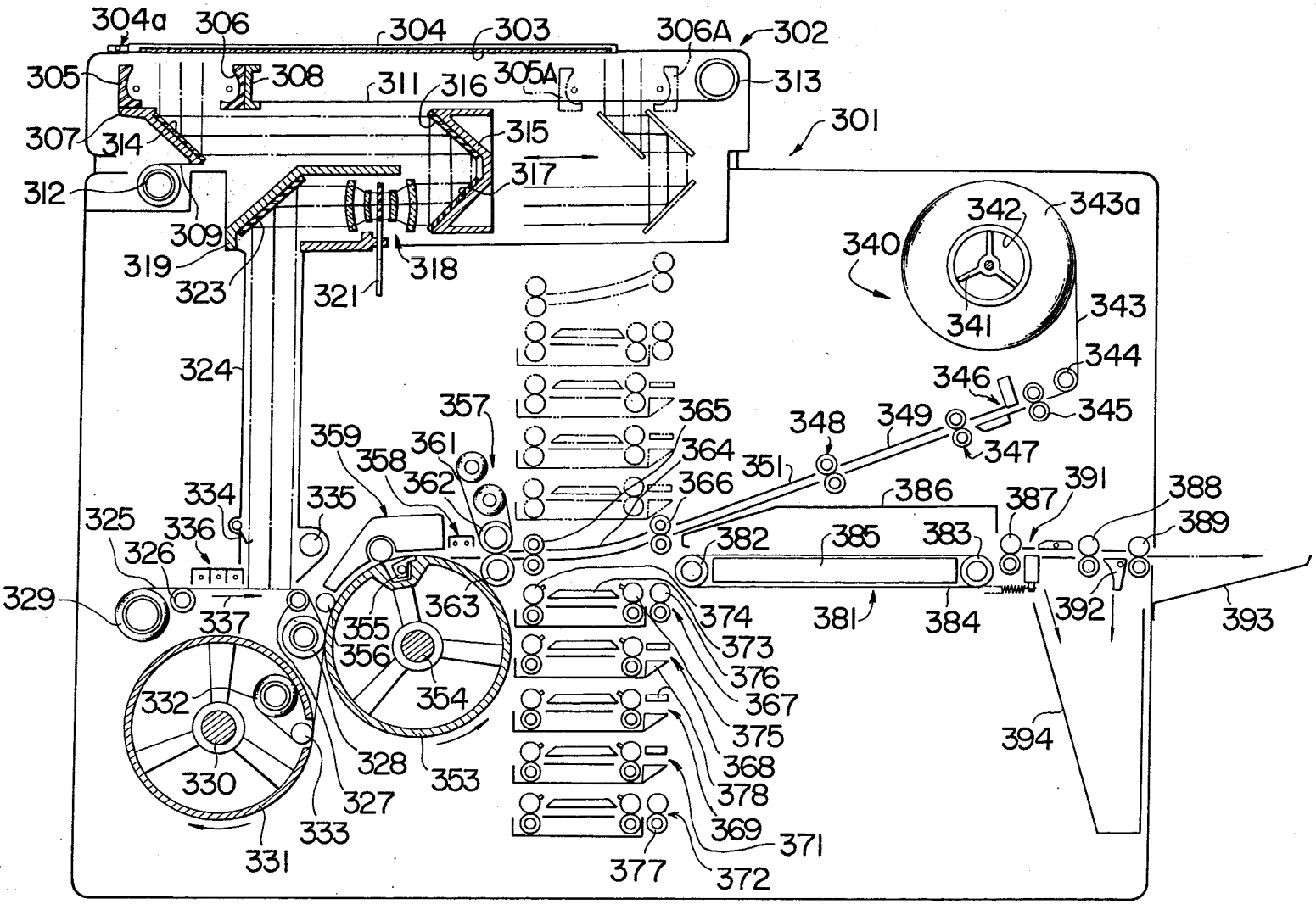
FIG. 12 is a front view of a color electrophotographic copying machine constructed in accordance with an additional embodiment of the invention.
Figure 13:
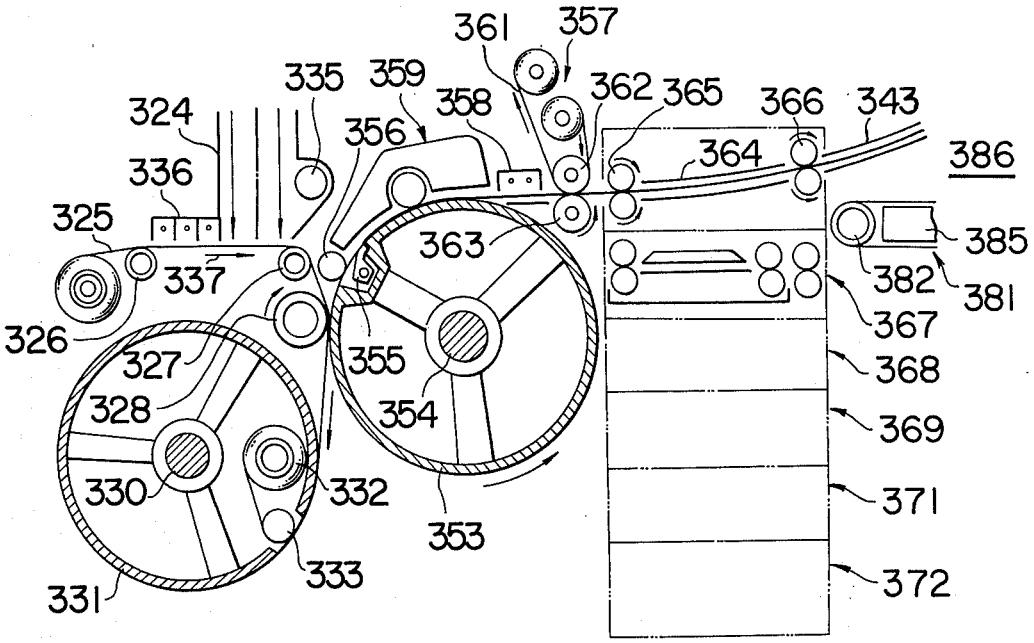
FIGS. 13 to 16 are fragmentary view illustrating the operation of the machine shown in FIG. 12.

Referring to FIG. 12 illustrating a further embodiment, there is shown a color electrophotographic copying machine 301 which includes a movable optical system 302. A transparent original receptacle 303 is disposed above the optical system, and is adapted to receive a color original, not shown. A cover 304 is fixedly mounted at its one end 304*a*, and can be raised from or closed against the receptacle so as to cover an original. A pair of lamp units 305 and 306 are disposed below the receptacle 302 for illuminating the color original, and are fixedly mounted on respective integral support members 307, 308. A pair of belt-shaped light shield members 309, 311 have their one ends secured to the support members 307, 308, respectively, and have their other ends wrapped around a pair of take-up rollers 312, 313 which are rotatably mounted on respective stationary members, thus preventing leakage of light from the lamp units. The lamp units 305, 306 are movable to positions 305A, 306A, shown in phantom lines, respectively, while scanning the color original.

A reflective mirror 314 is secured to the support member 307 and a pair of reflecting mirrors 316, 317 are secured to a movable member 315, these mirrors being effective to direct the reflected light from the color original toward a projection lens 318. The movable member 315 is adapted to move in the same direction as the support members 307, 308 but with one-half the travelling speed thereof so as to maintain the length of light path from the color original to the projection lens 318 constant. The projection lens 318 is fixedly mounted on a stationary member 319 and comprises a plurality of lenses. A support plate 321 is located centrally within the lens assembly 318 and is mounted so as to be rotatable relative to the stationary member 319. The plate 321 fixedly carries a plurality of color filters, and is capable of presenting different filters in the path of the reflected light through the rotation of the support plate 321. A reflecting mirror 323 and a shield plate 324 are secured to the stationary member 319, and the light image, after passing through the projection lens 318, is reflected by the mirror 323 to be projected onto a photosensitive member 325.

The photosensitive member 325 is in the form of a belt having a photoconductive characteristic, and extends around guide rollers 326, 327 and a transfer roller 328. One end of the member 325 is secured to a rewind roller 329 while its other end is wrapped around a supply roller 332 which is internally mounted within a take-up drum 331. The supply roller 332 and a guide roller 333 are rotatably mounted relative to the drum 331, and act to supply a fresh length of photosensitive member from the supply roller 332 as the photosensitive member 325 in use is degraded. A diaphragm 334 is disposed adjacent the lower end of the shield plate 324 for adjusting the amount of light which is made incident on the photosensitive member 325. There is also provided a discharge lamp 335 which removes residual charge from the photosensitive member 325 after an electrostatic latent image is transferred thereto. A charger 336 uniformly charges the photosensitive member 325 as the latter moves in the direction indicated by an arrow 337.

A rotatable member 341 carries a spool 342 on which a quantity of record sheet material 343 is wound to form a roll 343*a*, and the leading end of the record sheet material 343 which is unreeled therefrom is passed around a guide roller 344, between a pair of mating feed rollers 345 to a position where a cutter 346 is located. Pairs of feed rollers 347 and 348 are rotatably mounted on stationary members, and stationary guide members 349 and 351 are located adjacent thereto.

A drum 353 is disposed in the vicinity of the photosensitive member 325 and has a shaft 354 which is rotatably mounted on a stationary member, thus allowing the drum to rotate in opposite directions alternately. The drum 331, which acts to take up the photosensitive member 325, is also rotatable alternately in opposite directions about its shaft 330, thus reciprocating the photosensitive member 325. A clamp unit 355 is mounted on the peripheral surface of the drum 353 for clamping the leading end of the record sheet 343. A pressure roller 356 bears against the periphery of the drum 353 for urging the record sheet 343 thereagainst, and is also effective to facilitate a separation of the record sheet 343 from the photosensitive member 325 without imparting damage to the latter after completion of the transfer of the latent image. A blotter unit 357, which removes developing solution from a developed record sheet 343, a discharger 358 and a drying unit 359 are disposed adjacent to the periphery of the drum 353. The discharger 358 removes residual charge from the developed record sheet 343. The blotter unit 357 comprises a pair of rolls of blotting material 361, a roller 362 located intermediate the rolls, and another roller 363 which engages the roller 362.

Pairs of rotatable and interengaging feed rollers 365, 366 are disposed adjacent to the opposite ends of a guide member 364 and are incorporated as a unitary structure therewith. The guide member 364 guides a record sheet 343 when it is initially supplied from supply station 340 to the drum 353. A plurality of developing vessels 367, 368, 369, 371 and 372 are disposed in vertical alignment and adjacent to each other, with the topmost vessel 367 receiving a developing solution which contains a black toner for monochromatic application. The vessels 368, 369 and 371 disposed therebelow receive developing solutions which contain toners having a complementary color relationship with the respective color separation images, that is, a developing solution of yellow, magenta and cyan colors. The lowermost vessel 372 receives a developing solution containing a black toner which serves as a final color adjustment. The vessel 367 is associated with a guide member 373 and a pair of squeeze rollers 374 and 375 which are disposed on the left-hand and right-hand sides thereof. Other developing vessels are similarly constructed. Pairs of guide rollers 376 and 377, which convey the record sheet 343 to the right, are associated mechanically with the topmost and lowermost vessels 367 and 372, respectively. The remaining vessels 368, 369 and 371 are each associated with a guide member 378 which is fixedly mounted thereon at a position to the right thereof for guiding the record sheet 343 as it reciprocates.

A conveyor unit 381 is disposed to the right of the developing vessels, and comprises an endless belt 384, which extends around a pair of rotatable rollers 382 and 383, and a vacuum box 385 disposed intermediate the upper and lower runs of the belt for attracting the record sheet 343 against the belt 384. The endless belt 384 is driven in opposite directions for providing a reciprocatory motion of the record sheet 343, and is also driven clockwise to convey the record sheet 343 to the right during the final step. A drying unit 386 is disposed above the conveyor unit 381. To the right of the conveyor unit 381 are disposed pairs of interengaging rollers 387, 388 and 389 which rotate to convey the record sheet 343, a cutter 391 and a guide member 392. Subsequent to the final developing step, the record sheet 343 or a copy sheet is cut to size by the cutter 391 and is delivered onto delivery table 393, while chips are received in a dust box 394.

Figure 14:
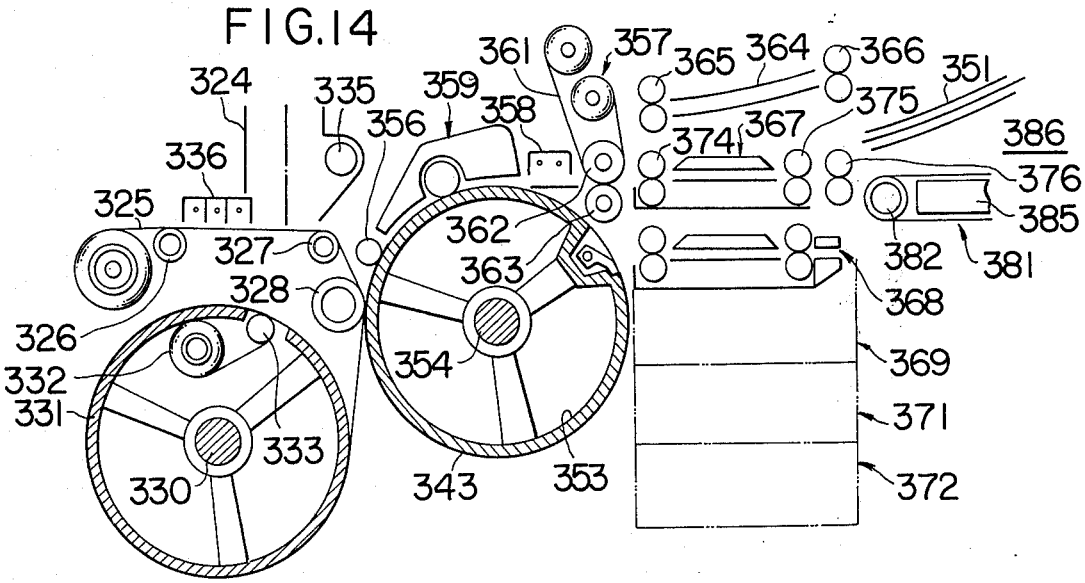

When a copying operation is initiated, a length of the record sheet material 343 which is unreeled from the roll 343*a* is guided by the guide member 364 disposed above the developing vessels and supplied toward the drum 353 which is rotated in the direction indicated by an arrow. The leading end of the record sheet is secured to the drum surface by the clamp unit 355. In interlocked relationship with the supply of the record sheet 343, the optical system 302 scans a color original, not shown, whereby a color separated light image is projected onto the photosensitive member 325, which is exposed to the image while travelling in the direction indicated by the arrow 337, thus forming an electrostatic latent image corresponding to the color separated image. As the photosensitive member 325 travels in this direction, the transfer roller 328 urges it against the record sheet 343, which is held around the priphery of the drum, thus transferring the latent image on the photosensitive member 325 to the record sheet 343. When the record sheet 343 is initially supplied to the peripheral surface of the drum 353, the sheet material is cut to a given length by the cutter 346, and when the transfer of the latent image is completed, the rear end of the record sheet 343 is retained by the pressure roller 356 as shown in FIG. 14. Consequently, when the record sheet 343 is to be conveyed in the opposite direction, or to the right, as viewed in the drawings, it is readily possible to separate the record sheet 343 from the photosensitive member 325.

Figure 15:
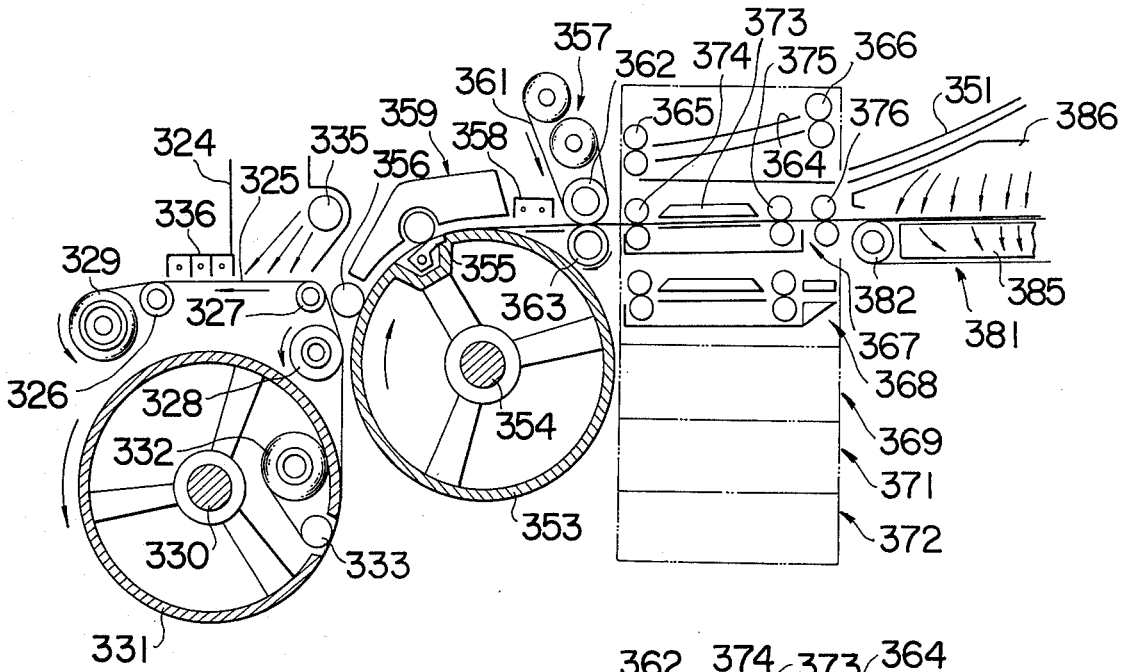

When a monochromatic original is used, the developing vessels and the guide member 364 are only one step, as illustrated in FIG. 14, thus locating the monochromatic developing vesses 367, containing a black toner, in alignment with the path of the record sheet 343. When the transfer of the latent image is completed, the transfer roller 328 is moved away from the drum 353, as shown in FIG. 15, to release the photosensitive member 325 from contact with the record sheet 343, and the photosensitive member 325 is moved in the opposite direction from that indicated by the arrow 327 by the rewinding operation of the rewind roller 329 which rotates in the direction indicated by an arrow. During such movement of the photosensitive member 325, the discharger lamp 335 removes any residual charge from the member 325. On the other hand, when the photosensitive member 325 moves in the direction of the arrow 327 to form an electrostatic latent image thereon, the charger 336 uniformly charges it. After transfer of the latent image, the record sheet 343 is fed into the developing vessel 367 by the drum 353 which now rotates in the opposite direction from that indicated by the arrow, as well as by the pair of rollers 374 located within the developing vessel 367, to perform a developing step, and is subsequently delivered by the conveyor unit 381 to the exterior of the copying machine being dried by the drying unit 386.

Figure 16:
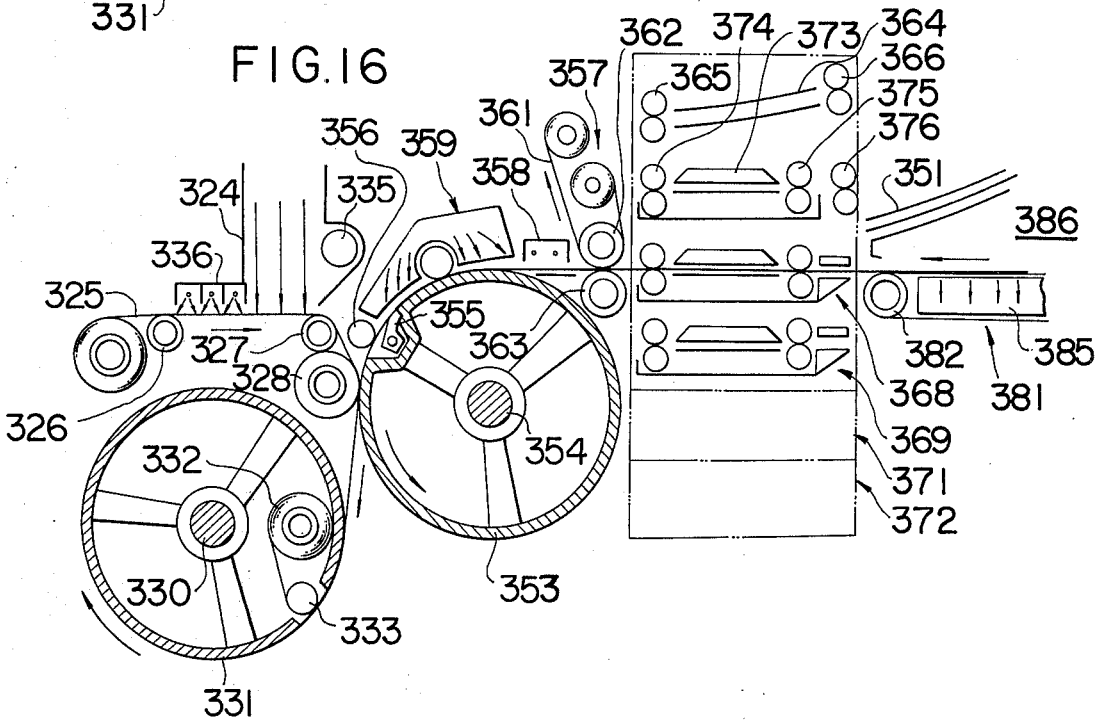

During a color copying operation, the guide member 364 and the respective developing vessels are moved by two steps upward when the transfer of the initial latent image is completed, whereby the vessel 368 containing an yellow toner is located in alignment with the path of the sheet as shown in FIG. 16, and the record sheet 343 is fed into this vessel 368 for developing and subsequently conveyed by the conveyor unit 381. After completion of the transfer of an electrostatic latent image corresponding to an initial color separation image and developing thereof with a toner (yellow) having a complementary color relationship therewith, the filter within the optical system 302 is changed to project a different color separated image onto the photosensitive member 325, which is transferred onto the record sheet 343 which is tightly held against the peripheral surface of the drum 353, as indicated in FIG. 16. Upon completion of such a transfer, the guide member 364 and the respective developing vessels are moved by one further step, whereby the vessel 369 containing a magenta toner having a complementary relationship with the next color separation image is located in alignment with the path of the sheet, thus developing it. Such a process is repeated for each changed filter and the latent images formed during each repeated process are superimposed one above another on the record sheet 343. It will be noted that for each process repeated, the respective developing vessels are raised upward to present a developing vessel containing a toner which has a complementary color relationship with a color separation image to be developed is disposed in alignment with the path of the sheet. As the record sheet 343 is moved toward the transfer station, or in a direction to be taken up on the pripheral surface of the drum 353, in order to be subjected to the next transfer operation subsequent to the completion of a developing step in any developing vessel, the pair of rollers 374 removes the previous developing solution from the sheet and the moisture is removed therefrom by the blotter unit 357, thus preventing interference with the transfer of the next electrostatic latent image. When the record sheet 343 is moved away from the transfer station upon completion of the transfer of the latent image, the respective developing vessels also act as a guide for the sheet, thereby providing a smooth movement thereof. After having initially guided the record sheet 343 to the drum 353, the guide member 364 is moved together with the developing vessels to a retracted position, thus avoiding interference with the conveying operation of the record sheet 343 into the plurality of developing vessels. In this manner, the record sheet 343 is formed with a color electrophotographic image corresponding to the color original to provide a copy sheet, which is finally conveyed to the right, as viewed in FIG. 12, by the conveyor unit 381 while being dried by the drying unit 386, and is cut to size by the cutter 91, whereupon it is delivered onto the table 393.

What is claimed is:

1. A color electrophotographic copying machine comprising a. a reciprocally rotatable drum;

b. means for supplying a copy sheet to the drum;

c. a roller disposed at a fixed position and maintained in rolling contact with the peripheral surface of said drum, for holding a portion of the length of the copy sheet between said roller and said drum so that said sheet is carried by said drum;

d. means operable to successively form a plurality of electrostatic latent images, corresponding to respective selected color separation images, on the copy sheet carried by the drum, each latent image being formed during a respective rotation of the drum in a first direction;

e. means disposed adjacent said drum for successively developing each electrostatic image with a respective toner developer which is associated with the corresponding color separation image, said developing means being adjustable to bring the respective toner developers successively into receiving relation with a copy sheet having a portion of its length held between said drum and said roller, but remaining stationary during each developing operation;

f. means operable to guide a selected free end of the copy sheet carried by said drum away from the peripheral surface of said drum for feeding of the copy sheet into the then stationary developing means subsequent to the formation of the electrostatic latent image during each such respective rotation of the drum in said first direction; and g. means operable to treat that surface of each copy sheet which has undergone developing by said developing means, in preparation for the formation of the next electrostatic latent image thereon, during respective rotations of said drum in a second direction opposite to said first direction, said drum rotating alternately in said first and second directions with said roller maintaining said portion of the length of each copy sheet engaged with said drum during such alternate rotations of said drum.

2. A color electrophotographic copying machine according to claim 1 in which said means for forming the electrostatic latent image comprises an imaging optical system for directly forming an electrostatic latent image on the copy sheet.

3. A color electrophotographic copying machine according to claim 1 in which the developing means is of a wet type.

4. A color electrophotographic copying machine according to claim 3 in which the surface treating means comprising a blotter for absorbing a liquid component from the copy sheet subsequent to the completion of the developing.

5. A color electrophotographic copying machine according to claim 3, in which said developing means includes a plurality of vessels for containing color developing solutions, each corresponding to a respective selected color separation image, each vessel having an inlet and the vessels being movable in a sequential manner, so as to bring the respective inlet openings sequentially into alignment with the free end of the copy sheet guided by said guiding means.

6. A color electrophotographic copying machine according to claim 1 in which said means for supplying the copy sheet comprises means for feeding a length of a copy sheet material to the drum from a roll thereof, and means for cutting the copy sheet material to a given length subsequent to the completion of one copying process.

7. A color electrophotographic copying machine comprising a. a reciprocally rotatable drum;

b. means for supplying a copy sheet to the drum;

c. a roller disposed at a fixed position and maintained in rolling contact with the peripheral surface of said drum, for holding a portion of the length of the copy sheet between said roller and said drum so that said sheet is carried by said drum;

d. means operable to successively form a plurality of electrostatic latent images, corresponding to respective selected color separation images, on the copy sheet carried by the drum, each latent image being formed during a respective rotation of the drum in a first direction;

e. means disposed adjacent said drum for successively developing each electrostatic image with a respective toner developer which is associated with the corresponding color separation image;

f. means operable to guide a selected free end of the copy sheet carried by said drum away from the peripheral surface of said drum for feeding of the copy sheet into the developing means subsequent to the formation of the electrostatic latent image during each such respective rotation of the drum in said first direction;

g. means operable to treat that surface of each copy sheet which has undergone developing by said developing means, in preparation for the formation of the next electrostatic latent image thereon, during respective rotations of said drum in a second direction opposite to said first direction, said drum rotating alternately in said first and second directions with said roller maintaining said portion of the length of each copy sheet engaged with said drum during such alternate rotations of said drum; and further means for securing the leading end of each copy sheet, fed by said supplying means, to the peripheral surface of said drum.

8. A color electrophotographic copying machine according to claim 7 in which said means for forming the electrostatic latent image comprise a belt-shaped photosensitive member having a photoconductor layer on its surface, and means for transfering an electrostatic latent image formed on the photosensitive member onto the copy sheet by transfer printing.

9. A color electrophotographic copying machine according to claim 8 in which said means for forming the electrostatic latent image further comprises means for releasing the photosensitive member from contact with the copy sheet during each rotation of the drum in a second direction opposite to the first direction.

* * * * *